United States Patent [19]

Blindheim

[11] 3,932,100

[45] Jan. 13, 1976

[54] VIBRATORY DEVICE

[75] Inventor: Rolf Blindheim, Oslo, Norway

[73] Assignee: A/S Ardal og Sunndal Verk, Oslo, Norway

[22] Filed: Feb. 20, 1975

[21] Appl. No.: 551,507

[30] Foreign Application Priority Data

Feb. 20, 1974 Norway ..... 564/74

[52] U.S. Cl. ..... 425/432; 425/412; 425/21

[51] Int. Cl.[2] ..... B30B 11/02; B28B 3/04

[58] Field of Search ..... 425/412, 415, 425, 432, 425/421

[56] References Cited

UNITED STATES PATENTS

| | | | |
|---|---|---|---|
| 2,028,021 | 1/1936 | Shippy | 425/415 |
| 2,057,466 | 10/1936 | Willetts | 425/415 X |
| 2,147,836 | 2/1939 | Gaskell | 425/415 |
| 2,755,532 | 7/1956 | Pallier | 425/412 X |
| 2,966,714 | 1/1961 | Eways et al. | 425/432 |
| 3,471,910 | 10/1969 | Slavin | 425/432 X |
| 3,555,599 | 1/1971 | Weinhold | 425/432 X |
| 3,712,785 | 1/1973 | Hirt et al. | 425/432 X |

*Primary Examiner*—J. Howard Flint, Jr.
*Attorney, Agent, or Firm*—Wenderoth, Lind & Ponack

[57] ABSTRACT

A device for moulding "green" blocks or electrodes for the manufacture of anode and cathode carbons for the smelting industries, with particular reference to the electrolytic smelting of aluminium, utilizing a vibratory or shaking motion, in which the paste which is to form the blocks or electrodes is filled into a mould. The mould comprises a plane, horizontal base or table, vertical walls or sides of which at least one is removable to facilitate the ejection or discharging of the finished block, and a pressure weight slidable in vertical guides, the downward-facing surface of which weight covering essentially the whole of the cross section of the mould. On the weight, and only on the weight, there is disposed at least one vibration generator. The base of the mould is stationary, and the walls or sides of the mould are so arranged as to be firmly fixed to the base during the moulding process.

6 Claims, 1 Drawing Figure

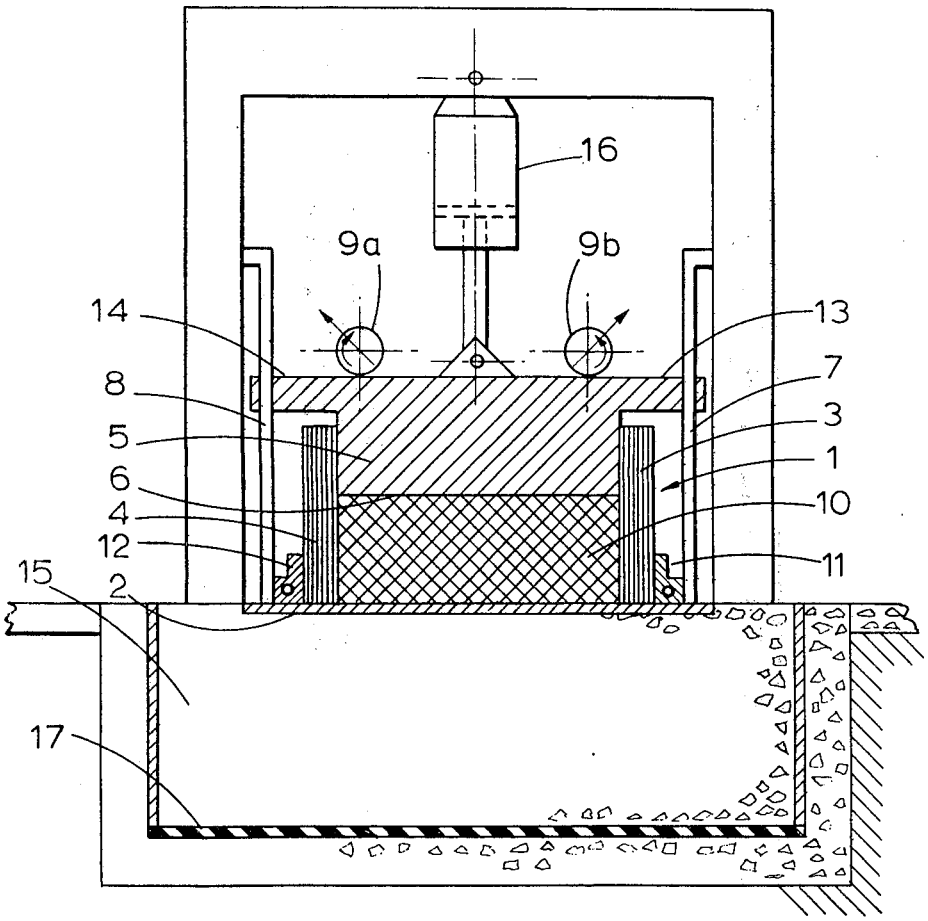
16
9a
9b
14
13
8
7
5
3
6
1
4
10
12
11
15
2
17

VIBRATORY DEVICE

BACKGROUND OF THE INVENTION

In the electro-smelting industry, with particular reference to the electrolytic smelting of aluminium, the production of anodes and cathodes often accounts for a large part of the operations and of the production cost of the final metal yield. An important process in the manufacture of anode and cathode carbons for such industries is the moulding of the socalled green blocks or electrodes which, after further processing — particularly baking —, become the various types of anode carbons and cathode carbons required.

The paste compound which is used for producing anode and cathode carbons of this type usually consists, when required for the aluminium smelting industry, of pitch and petroleum coke as the main components, and this paste is tamped or compressed in a mould in order to produce the green electrodes which are subsequently subjected to a baking process.

A vibratory or shaking motion has for a long time been used for compacting the ingredients constituting the paste in a mould for forming the green electrodes. The equipment used for this vibrating process performs a key operation in the procedure for producing anode and cathode carbons. A number of strict demands are made of this vibratory equipment, which can be summarized as follows:

1. It must produce green electrodes of good quality for the subsequent baking operation, and for use in the smelting or electrolytic reduction process, i.e. blocks of high density.
2. The equipment must be operationally reliable and as little prone as possible to faults or damage resulting from wear or other stresses.
3. The costs of procuring, installing and operating the equipment must be as low as possible.
4. Noise and vibration from the vibratory equipment to the surroundings must be reduced to the lowest possible level, so as to give an acceptable work environment, and also because of wear and other stresses on the equipment.

The type of equipment under discussion here has, for a number of years, been the object of a great many major and minor improvements and, almost up to the time of writing, numerous proposals for new ways of improving the process and the equipment used have been put forward. The technique which is standard usage to-day is thus the result of a long development, originating from the manual operation of pneumatic tamping (ramming) tools for compacting the paste in a mould. Using the manual method it was often found necessary to ram the paste into the mould, layer upon layer, in order to achieve the desired density throughout the entire body of the resultant block.

On account of the difficulty of obtaining adequate compaction throughout the whole of the block by ramming manually from above, it was considered necessary, on changing over to mechanized equipment, to make use of a shaking table, i.e. a vibrating base in the mould. All known equipment of this type has been based on vibration from below, and usually vibration of the bottom of the mould, or the mould table, and also of the vertical mould walls or sides.

One of the main reasons why experts in this field have assumed the vibration of the base or the table to be an unavoidable necessity in this connection, is probably that previous experience had shown that only the upper part of the paste was sufficiently compacted when worked from on top with manually manipulated tamping or ramming device.

As examples of the present state of the art, reference may be made to German Patent No. 1,758,297.4, which relates to complicated devices for the application of a vacuum in the vibrating or shaking process. French Patent No. 2,033,909 discloses a large number of different proposals aimed, inter alia, at furnishing equipment less liable to damage, fatigue failure and wear. In addition to the use of a vibratory table as base, it is also proposed to vibrate a cover plate over the paste which is to be compacted. The mould walls are supported independently of the vibratory table, and also independently of the cover plate. The device is thus of very complicated design, and comprises a large number of parts, with the result that it is difficult to achieve the stated objective because the larger the number of parts, the greater the likelihood of damage and faults occurring. Another significant problem is that the oscillatory system becomes very complicated and intricate.

SUMMARY OF THE INVENTION

The present invention, in consideration of the above, refers to a device of the type in which the paste which is to form the green electrode is filled into a mould comprising a plane, horizontal base or table, vertical walls or sides of which at least one is removable for discharging the finished electrodes, and a press-weight, movable in a vertical guiding device, the downward-facing surface of which essentially covers the entire cross section of the mould.

Contrary to the principles on which the conventional technique described above is based, it has, surprisingly, in connection with the present invention, been found that a fully satisfactory compacting effect is achieved by there being disposed one or more vibration generators on the cover or pressure weight only, by the base being stationary, and by the walls of the mould being so arranged that they are firmly fixed to the base during the forming process. This solution, which is completely contrary to all theories on which experts hitherto have based their work, brings a number of advantages when manufacturing green blocks for the production of anode and cathode carbons for the smelting industries, with particular reference to the electrolytic smelting of aluminium. A significant advantage is that the oscillatory system becomes substantially simplified and thus less intricate, so it is easier to make adjustments to suit varying operating parameters, particulary variations in the paste compound to be compacted. Further, the construction is of simpler design, making the device much cheaper to procure and install. Last but not least, it must also be pointed out that the noise generated by equipment based on this new solution can be reduced to a level lower than that usual hitherto in such equipment. An improvement of this aspect is of significant importance, as the working environment around such plants is at times very exposed. The reduction of noise and vibration, coupled with the simpler design and construction, further results in equipment suffering less wear and requiring less maintenance. This, understandably, is due to the fact that the number of vibrating parts is smaller.

BRIEF DESCRIPTION OF THE DRAWING

The present invention will, in the following, be explained in more detail with reference to the attached drawing which, purely in diagram form and greatly simplified, depicts a device according to the invention intended for the moulding of green electrodes for producing anodes for use in the industrial electrolytic smelting of aluminium.

DETAILED DESCRIPTION OF THE INVENTION

The device in the drawing consists of a mould 1 comprising a base 2 and mould walls or sides 3 and 4 which are firmly fixed to the base 2 by means of fixing members 11 and 12. To facilitate the removal of the green electrodes 10 when they are finished, at least one of the mould walls is made removable in that the appertaining fixing member(s) can be loosened.

A cover or pressure weight 5, in similarity with conventional embodiments, is arranged to enter the mould 1 from above in such a manner that the downward-facing surface 6 of the weight 5 essentially fills the whole of the cross section of the mould between the vertical walls 3 and 4. For vertically guiding the weight 5 there are disposed, also in accordance with the conventional technique, guides 7 and 8 which operate in conjunction with guide members 13 and 14 on weight 5.

On weight 5 there are disposed two vibration generators 9*a* and 9*b* which provide the requisite vibratory or shaking movement of the device. These vibration generators may be of per se known and conventional type. The net mass forces of these vibration generators cancel each other out in the horizontal plane thus producing net components solely in the vertical direction. If required, a number of such vibration generators can be mounted on weight 5. In addition to impressing vibrations on the weight, the latter can, also in known manner, be subjected to a constant pressure force, for example by means of a hydraulic ram 16. In such an event, a lighter weight can be used.

The stationary base 2 with its appertaining walls 3 and 4 is, in practice, expediently placed on a solid foundation 15 which may, for example, consist of a large concrete block resting on vibration dampers, for example rubber blocks 17.

The embodiment illustrated here in outline can, of course be modified in various ways within the scope of this invention. Thus, for example, the mould, instead of consisting of four separate walls, could be round, i.e. have a circular mould wall; the cross section of the cover weight being of corresponding shape. Further, a separate ejector plate could be fitted over the base 2 to facilitate the removal from the mould of the finished green electrode.

I claim:

1. A device for molding green blocks or electrodes for the manufacture of anode and cathode carbons for smelting industries, particularly for the electrolytic smelting of aluminum, said device comprising:

a mold including a stationary, plane, horizontal base, and vertical walls firmly fixed to said base and extending upwardly therefrom, thereby providing a chamber for the receipt of paste to be formed into a block, at least one of said vertical walls being removable from said base to facilitate the discharge of a finished block from said mold;

a pressure weight slidably mounted for vertical movement into said chamber, said weight having a lower downwardly facing surface of a configuration to cover substantially the entire horizontal cross-sectional area of said chamber; and vibration generator means mounted only on said weight for imparting thereto vibratory motion for compacting paste positioned in said chamber.

2. A device as claimed in claim 1, including four of said vertical walls forming a chamber of rectangular horizontal cross-section.

3. A device as claimed in claim 1, wherein said vertical walls form a chamber of circular horizontal cross-section.

4. A device as claimed in claim 1, further comprising vertical guide means for guiding vertical movement of said weight.

5. A device as claimed in claim 1, further comprising constant pressure means for applying a constant downward force to said weight.

6. A device as claimed in claim 1, wherein said vibration generator means comprises a plurality of vibration generators mounted on the top of said weight.

* * * * *